United States Patent [19]

Lodovico et al.

[11] Patent Number: 4,862,796

[45] Date of Patent: Sep. 5, 1989

[54] APPARATUS FOR CRUSHING CANS

[75] Inventors: Frank J. Lodovico, Delmont, Pa.; John W. Wagner, Rte. 1, Box 943, New Alexandria, Pa. 15670; Richard D. Cerra, Murrysville, Pa.

[73] Assignee: John W. Wagner, New Alexandria, Pa.

[21] Appl. No.: 144,798

[22] Filed: Jan. 15, 1988

[51] Int. Cl.[4] ..... B30B 3/04

[52] U.S. Cl. ..... 100/173; 100/94; 100/144; 100/155 R; 100/176; 100/295; 100/902; 241/235

[58] Field of Search ..... 100/94, 98 R, 155 R, 100/161, 172, 173, 176, 902, 95, 96, 144, 159, 295; 241/99, 100, 187, 235, 236

[56] References Cited

U.S. PATENT DOCUMENTS

| | | | |
|---|---|---|---|
| 697,311 | 4/1902 | Acklin | 241/236 X |
| 1,181,660 | 5/1916 | Gensheimer | 100/94 |
| 1,598,364 | 8/1926 | Cassell et al. | 100/902 (X) |

FOREIGN PATENT DOCUMENTS

| | | | |
|---|---|---|---|
| 1120998 | 7/1956 | France | 241/235 |
| 56-36399 | 4/1981 | Japan | 100/95 |
| 65162 | 8/1942 | Norway | 241/235 |

*Primary Examiner*—Harvey C. Hornsby

*Assistant Examiner*—Stephen F. Gerrity

*Attorney, Agent, or Firm*—James L. Sherman

[57] ABSTRACT

An apparatus is for crushing at least one of a plurality of metal cans having a predetermined diameter and a predetermined length less than about twice the predetermined diameter. The apparatus includes a pair of cylindrical rollers mounted for rotation in opposite directions about parallel horizontal axes with a predetermined distance therebetween. Each of the rollers has a predetermined roller diameter greater than four times the predetermined diameter of the can. An array of extensions on the cylindrical surface of each of the rollers extends a predetermined height from the cylindrical surface and is separated from adjacent extensions on the cylindrical surface to cause the extensions of the array to cover less than ten percent of the cylindrical surface to allow general alignment of and positioning of the metal cans therebetween. The predetermined distance between the horizontal axes of the rollers is greater than the predetermined roller diameter and less than the predetermined roller diameter plus the predetermined height. As a result, the array of extensions cause the cans to generally align with the cylindrical surface of the rollers and to be retained in alignment therewith as the cans pass between the rollers and are primarily crushed between facing portions of the cylindrical surfaces of the rollers.

5 Claims, 1 Drawing Sheet

APPARATUS FOR CRUSHING CANS

BACKGROUND OF THE INVENTION

1. FIELD OF THE INVENTION.

This invention relates to an apparatus for crushing individual metal cans of a plurality of metal cans.

2. DESCRIPTION OF THE PRIOR ART.

Recent legislation regulating the collection and disposition of disposable containers such as plastic bottles and metal cans in the soft drink industry has resulted in increased interest in machines that can be employed to reduce the size of the used containers to simplify handling and storage. Three machines respectively disclosed in U.S. Pat. Nos. 3,857,334; 4,009,838; and 4,285,426 represent specific devices intended to satisfy specific needs in this regard. The latter two machines are primarily intended to tear or shred plastic bottles and/or metal cans into smaller pieces. These and other, similar machines are outside of the scope of the present invention and are directed to a completely different process.

On the other hand, the device of U.S. Pat. No. 3,857,334 discloses an apparatus for crushing containers individually by the use of a ram and platen. Although such individual crushing may be considered desireable because of the dual purpose of dispensing a token, repeated crushing of individual or groups of soft drink containers in this manner can result in serious problems in the ram mechanism because of the quantity of soft drink fluid which is left in each individual container. Consequently, although a ram might be used for crushing numerous containers or cans one at a time, the accompanying problems associates with the soft drink fluid left in each container would seriously complicate cleaning and maintenance and the overall life of such a device.

For some purposes, it is desireable to be able to crush individual cans of a large quantity of cans so that the resulting crushed containers can be individually conveyed, stacked, collected and handled. In other words, although an apparatus need not treat each container individually for the dispensing of a token as in U.S. Pat. No. 3,857,334, the final crushed containers should be sufficiently individual for transmittal by a conveyer belt or other means for eventual collection and handling. The devices shown in U.S. Pat. Nos. 3,155,028; 3,489,354; and 3,504,621 appear to be capable of crushing larger quantities of containers. Whether the containers are actually crushed individually or not is unclear. What is clear, however, is that each of these devices either includes multiple sets of rollers or moving components which highly complicates the operation of the devices and makes them questionable for operation in what has been found to be a hostile environment of the soft drink fluids which remain in such used cans and containers. The soft drink fluid is extremely cohesive and corrosive and extended operation of such a device requires significant periodical maintenance to attempt to remove this material from the apparatus.

Consequently, there remains a need for a simple apparatus for crushing metal cans which will tend to cause individual cans to be separately crushed for collection, transportation and disposition. Such an apparatus might also be used in other industries such as the food processing industry where large quantities of cans of food ingredients are used and must be disposed of thereafter. As a result, there may be similar concerns regarding the material left in such cans and similar needs for collection and transportation as is found in the soft drink industry. Accordingly, a machine which can properly crush cans for the soft drink industry might have similar application in other industries and would therefor not be limited to the soft drink industry.

SUMMARY OF THE INVENTION

It is an object of the present invention to provide apparatus for crushing at least one of plurality of metal cans.

It is another object to provide such apparatus which will tend to crush the cans of the plurality of metal cans individually for disposition and collection thereafter.

It is yet another object of the invention to provide such an apparatus which is simple and which can be readily cleaned and maintained.

These and other objects of the invention are provided in a preferred embodiment including an apparatus for crushing at least one of a plurality of metal cans having a predetermined diameter and a predetermined length less than about twice the predetermined diameter. The apparatus includes a pair of cylindrical rollers mounted for rotation in opposite directions about parallel horizontal axes with a predetermined distance therebetween. Each of the rollers has a predetermined roller diameter greater than four times the predetermined diameter of the cans. Aligning and gripping means extend from the cylindrical surface of each of the rollers and includes an array of extensions each of which extends a predetermined height from the surface and is separated from adjacent extensions on the cylindrical surface. The separation from adjacent extension causes the extensions of the array to cover less than 10 percent of the cylindrical surface to allow general alignment and positioning of the metal cans therebetween. The predetermined distance between the horizontal axes of the rollers is greater than the predetermined roller diameter and less than the predetermined roller diameter plus the predetermined height of the extensions. As a result, the aligning and gripping means cause the cans to generally align with the cylindrical surface of the rollers and to be retained in general alignment therewith as the can passes between the rollers and is primarily crushed between facing portions of the cylindrical surface of the rollers.

DETAILED DESCRIPTION OF A PREFERRED EMBODIMENT

Figure 1:
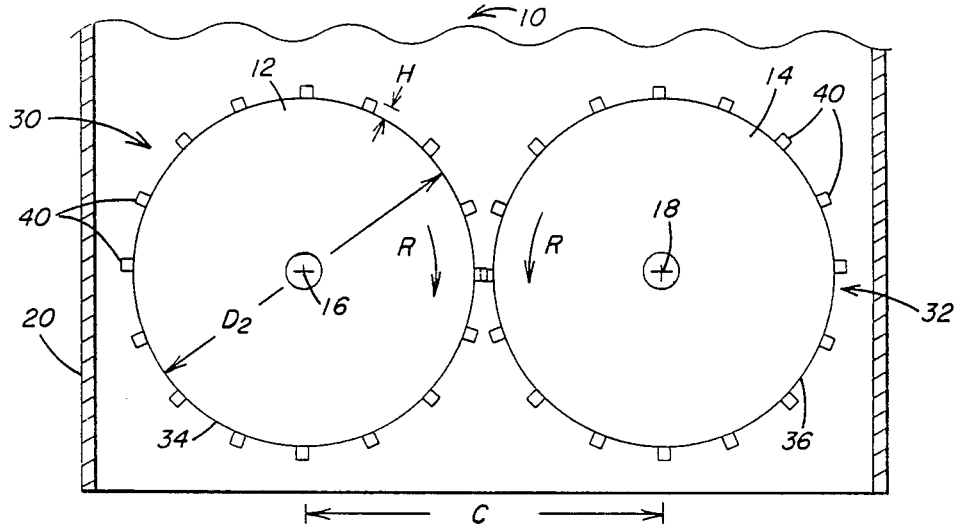
FIG. 1 is an elevational schematic view of a preferred crushing apparatus including various features of the invention.
Figure 2:
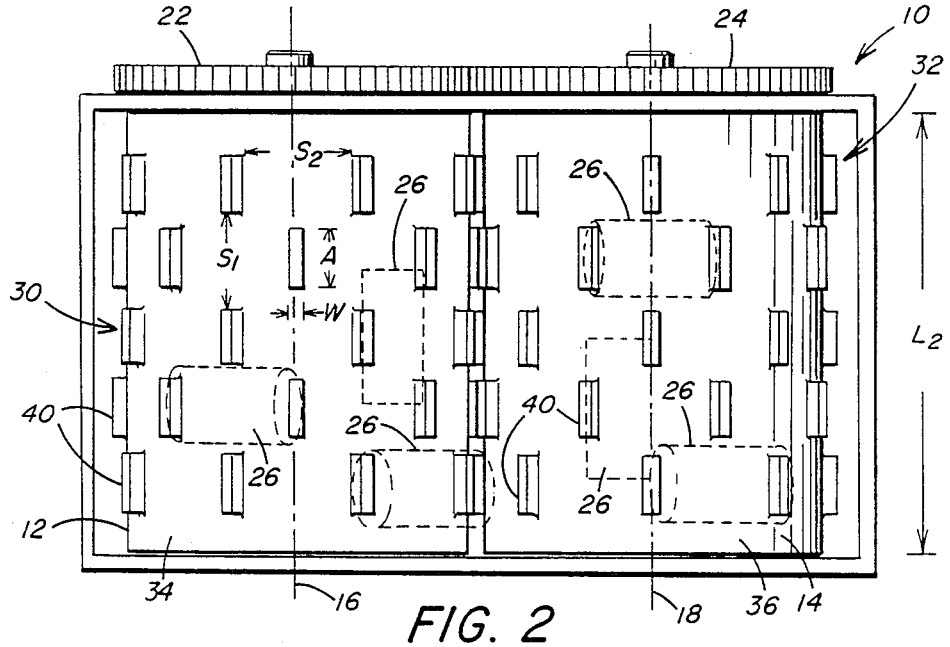
FIG. 2 is a top view of the apparatus of FIG. 1.

As seen in FIGS. 1 and 2 a preferred apparatus 10 for crushing metal cans includes a pair of cylindrical rollers 12, 14 mounted for rotation in opposite directions (as indicated by the arrows R) about parallel horizontal axes 16, 18 with a predetermined distance C therebetween. Specifically, the rollers 12, 14 are mounted within a housing 20 and, although not shown, may be caused to rotate by any number of means which are well known in the machinery art. Specifically, the corresponding rotation can be produced by interconnecting spur gears 22, 24.

While the present invention is not limited to soft drink cans as mentioned in the background of the invention, the preferred configuration is particularly adapted for such metal cans 26. A typical soft drink can has a diameter D1 of about 2.5 inches and a length L1 of about 4.87 inches. In other words, the length L1 is slightly less that twice the diameter D2. As mentioned hereinabove, metal cans such as those found in the soft drink industry or metal cans used in various processing systems might include substance left therein which will remain in the apparatus and require periodic maintenance and cleaning for proper operation of the apparatus 10.

To insure proper alignment and gripping of the cans 26 identical aligning and gripping means 30, 32 are mounted respectively on the cylindrical surfaces 34, 36 of the cylindrical rollers 12, 14. The aligning and gripping means 30, 32 include an array of extensions 40 made of bar stock material which are directly welded to the cylindrical surfaces 34, 36. Specifically, the extensions 40 have a predetermined height H, a predetermined width W and a predetermined axial length A. Additionally, each extension 40 is separated from adjacent extensions 40 on its respective cylindrical surface 34, 36 to cause the extensions of the array to cover less than 10 percent of the cylindrical surface and to cause general alignment and positioning of the metal cans therebetween. In other words, although numerous cans 26 can be deposited above the rollers 12, 14, the extensions 40 on the surface thereof are particularly arranged to produce a general alignment of the cans 26 on the surfaces 34, 36 so that those at the surfaces will tend to be individually crushed as they pass between the rollers 12, 14. While the cans 26 shown in FIG. 2 demonstrate various possible alignments of the cans along the surface, it should be understood that other alignments are also possible. However, the particular configuration of extensions 40 will cause a churning and mixing of a plurality of cans above the rollers 12, 14 so that most of the cans 26 being directed to the upper surfaces thereof will tend to be generally aligned in one of the positions shown in FIG. 2.

Figure 3:
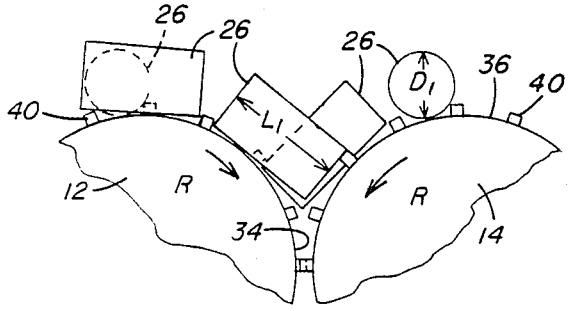
FIG. 3 is a fragmentary view of a portion of the apparatus of FIG. 1 showing one possible arrangement for cans being crushed therein.
Figure 4:
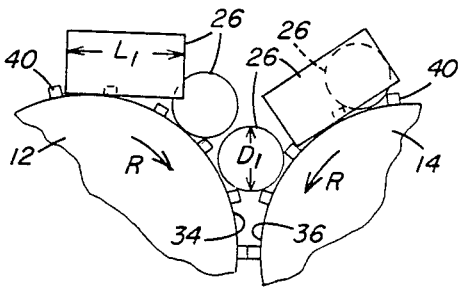
FIG. 4 is a fragmentary view of a portion of the apparatus of FIG. 1 showing other possible arrangements of the cans being crushed therein.

While FIG. 2 generally represents the positions as seen from above, FIGS. 3 and 4 show various positions from the side of the rollers 12, 14 as the cans are being advanced for passing therebetween just prior to their being crushed between the rollers 12, 14. Clearly numerous other cans above those shown have not been included in the Figures. Even though there would probably be constant mixing and churning of the cans above and on the surfaces 34, 36, the desired alignment will generally be obtained prior to crushing.

Clearly, for such a configuration to be possible, the diameter D2 of the rollers 12, 14 must be sufficiently large to enable the cans 26 to generally lie upon the surface thereof. In the preferred configuration the diameter D2 is 12 inches although a diameter D2 which is greater than four times the predetermined diameter D1 of the can 26 could be sufficiently large for the desired crushing. Similarly, to insure that the extensions 40 are capable of aligning and gripping without interferring with the general direction of the cans 26 to the cylindrical surfaces 34, 36 the actual size and relationship of the extensions 40 is significant with respect to the can 26. Accordingly, in the preferred apparatus 10, the extensions 40 are made of two inch bar stock so that the axial length A is about two inches and the height H is $\frac{3}{8}$ of an inch and the width W is $\frac{3}{8}$ of an inch. The axial alignment and spacing and the circumferential alignment and spacing are such that the spaces S1 and S2 are about three inches and about four inches respectively. The extensions 40 should cover less than ten percent of the cylindrical surfaces 34, 36. Accordingly, the axial length A is less than the diameter D1 but greater that one half of the diameter D1 of the can while the spaces S1, S2 are greater than the diameter D1 of the can 26. It should also be noted that the height H is between ten percent and twenty percent of the diameter D1 of the can 26. A general examination of the preferred dimensions and relationships presented above show that the extensions 40 of the preferred aligning and gripping means provide sufficient surfaces for generally aligning and gripping but do not primarily interfere with the cans being directed to the surfaces 34, 36 for primary crushing thereby as the can pass between rollers 12, 14. In other words, creating extension 40 which extend too high above the surfaces 34, 36 would simply stir up the cans and prevent easy and convenient alignment rather than assist it. Additionally, the greater the height H the farther apart the rollers 12, 14 would by necessity be. In the present configuration, the distance between the axes C is greater than the diameter D2 of the roller and less than the diameter D2 of the roller plus the height H of the extensions 40.

It should be noted that the overall length L2 of the rollers 12, 14 is preferably about 15 inches in the preferred apparatus 10. This enables several cans to be crushed at the same time but still provide sufficient cylindrical surface for the cans to be maintained individually as discrete crushed cans after passing between the rollers 12, 14.

While the overall configuration disclosed hereinabove includes a configuration which will allow proper alignment while still being capable of properly gripping the cans 26, the actual speed of rotation in the direction R is significant to prevent undue churning, mixing or, ripping or tearing of the cans during the crushing action. Accordingly, it is recommended that the RPM of the rollers be greater than 4 but less than 10 revolutions per minute while the preferred roller speed is about 6 revolutions per minute.

Finally, while the present configuration can now be seen to facilitate crushing of cans in a discrete and separate manner to allow any desired collection thereof after the crushing step. In other words, the individual crushed cans can then be directed to a conveyer or container or any other type of disposition desired. Interconnecting of the crushed cans and/or shredding of the can material which might interfere with the conveying or collection is minimized.

Finally, it should also be clear that the rollers 12, 14 and the simple extension 40 thereon are easy to provide and are of a configuration which can be more easily cleaned and maintained. It cannot be over emphasized that the overall reliability of such an apparatus 10 is directly affected by the ability to conveniently clean and maintain the rollers 12, 14 thereof.

We claim:

1. An apparatus for crushing at least one of a plurality of metal cans having a predetermined diameter and a predetermined length less than about twice said predetermined diameter, said apparatus comprising:

a pair of cylindrical rollers mounted for rotation in opposite directions about parallel horizontal axes with a predetermined distance therebetween;

each of said rollers having a predetermined roller diameter greater than four times said predetermined diameter;

aligning and retaining means extending from the cylindrical surface of each of said rollers for generally aligning said cans with said cylindrical surfaces and for retaining said cans in alignment with said cylindrical surfaces as each of said cans passes between said rollers and is primarily crushed between facing portions of said cylindrical surfaces of said rollers;

said aligning and retaining means including an array of extension each of which extends a predetermined height from said cylindrical surface and is separated from adjacent said extensions on said cylindrical surface to cause said extensions of said array to cover less than ten percent of said cylindrical surface to allow general alignment and positioning of said metal cans therebetween; and said predetermined distance between said horizontal axes of said rollers being greater than said predetermined roller diameter and less than said predetermined roller diameter plus said predetermined height.

2. The apparatus as set forth in claim 1, wherein each said extension includes an axially aligned bar secured to said cylindrical surface to have said predetermined height between ten percent and twenty percent of said predetermined diameter and an axially length greater than one half of said predetermined diameter and less than said predetermined diameter.

3. The apparatus as set forth in claim 2, wherein each said bar is separated from axially adjacent other said bars by an axial space greater than said predetermined diameter and from circumferentially adjacent other said bars by a circumferential space greater than said predetermined diameter.

4. The apparatus as set forth in claim 1, wherein said rollers rotate at a speed greater than four revolutions per minute and less than ten revolutions per minute.

5. The apparatus as set forth in claim 4, wherein said rollers rotate at a speed of about six revolutions per minute.

* * * * *